US009035734B2

(12) United States Patent
Ohtsubo et al.

(10) Patent No.: US 9,035,734 B2
(45) Date of Patent: May 19, 2015

(54) COIL COMPONENT

(71) Applicant: PANASONIC CORPORATION, Osaka (JP)

(72) Inventors: Mutsuyasu Ohtsubo, Hyogo (JP); Ryusuke Teramoto, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/045,694

(22) Filed: Oct. 3, 2013

(65) Prior Publication Data

US 2014/0097921 A1 Apr. 10, 2014

(30) Foreign Application Priority Data

Oct. 10, 2012 (JP) ..... 2012-224784
Dec. 6, 2012 (JP) ..... 2012-267136
Jul. 4, 2013 (JP) ..... 2013-140457

(51) Int. Cl.
*H01F 27/02* (2006.01)
*H01F 17/00* (2006.01)
*H01F 27/29* (2006.01)
*H01F 17/04* (2006.01)

(52) U.S. Cl.
CPC ..... *H01F 27/29* (2013.01); *H01F 27/292* (2013.01); *H01F 2017/048* (2013.01)

(58) Field of Classification Search
CPC ..... H01F 2017/048; H01F 41/0246; H01F 27/292; H01F 27/29; H01F 41/127; H01F 41/10; H01F 27/2828; H01F 27/022; H01F 5/04; H01F 41/005
USPC ..... 336/83, 177, 192
See application file for complete search history.

(56) References Cited

U.S. PATENT DOCUMENTS 6,114,932 A * 9/2000 Wester et al. ..... 336/65
6,204,744 B1 * 3/2001 Shafer et al. ..... 336/83
6,504,463 B1 * 1/2003 Kato et al. ..... 336/83
6,808,642 B2 * 10/2004 Takaya et al. ..... 216/13
6,940,387 B2 * 9/2005 Shibata et al. ..... 336/200
7,034,645 B2 * 4/2006 Shafer et al. ..... 336/83
7,142,084 B2 * 11/2006 Cheng ..... 336/200
7,786,834 B2 * 8/2010 Yagasaki et al. ..... 336/192
7,994,888 B2 * 8/2011 Ikriannikov ..... 336/192
8,018,310 B2 * 9/2011 Hansen et al. ..... 336/192
8,174,348 B2 * 5/2012 Ikriannikov ..... 336/192

FOREIGN PATENT DOCUMENTS

JP 2005-310868 A 11/2005

* cited by examiner

*Primary Examiner* — Alexander Talpalatski
*Assistant Examiner* — Joselito Baisa
(74) *Attorney, Agent, or Firm* — McDermott Will & Emery LLP

(57) ABSTRACT

A coil component includes a coil section, an outer package, and a pair of outer electrodes. The outer package is made of magnetic material, embeds the coil section therein, and has a bottom face, a top face provided with cut-out sections, a first lateral face, and a second lateral face. Each of the pair of outer electrodes extends from both ends of the coil section, and is pulled out from the first lateral face, and then is bent toward the bottom face, and yet is bent along the bottom face and the second lateral face, and finally is bent toward the cut-out section of the top face. Recesses are formed on the bottom face at places overlapped with the pair of outer electrodes, and each of the outer electrodes is bent to form a projection protruding inside the corresponding recess.

15 Claims, 7 Drawing Sheets

COIL COMPONENT

BACKGROUND

1. Technical Field

The present disclosure relates to a coil component to be used in a variety of electronic devices, and more particularly it relates to a coil component working with a large current.

2. Background Art

In recent years, a number of coil components has been used for working with large current in a DC/DC converter circuit and the like disposed near a car engine.

FIG. 13 is a lateral sectional view of a conventional coil component mounted to a substrate. The conventional coil component includes coil section 1, magnetic core 2, and terminal sections 3. Magnetic core 2 is formed by covering coil section 1 with a mixture of magnetic material powder and insulating binder before pressure-molding. Terminal sections 3 are electrically connected to coil section 1, and are bent along lateral faces and a bottom face of magnetic core 2. This coil component is soldered to substrate 4 with solder 5.

SUMMARY

Each one of the coil components in accordance with various embodiments includes a coil section, an outer package, and a pair of outer electrodes. The outer package is made of magnetic material, and embeds the coil section therein. The outer package has a bottom face, a top face disposed opposite the bottom face and having cut-out sections, a first lateral face, and a second lateral face placed opposite the first lateral face. The pair of outer electrodes extend from both ends of the coil section respectively, and come out from the first lateral face, and then are bent toward the bottom face, yet are bent along the bottom face and the second lateral face, and are finally bent toward the cut-out sections of the top face. Recesses are formed on the bottom face at places overlapped with the pair of outer electrodes respectively. Each one of the electrodes is bent to form a projection protruding inside of corresponding each one of the recesses.

DESCRIPTION OF EMBODIMENTS

Figure 13:
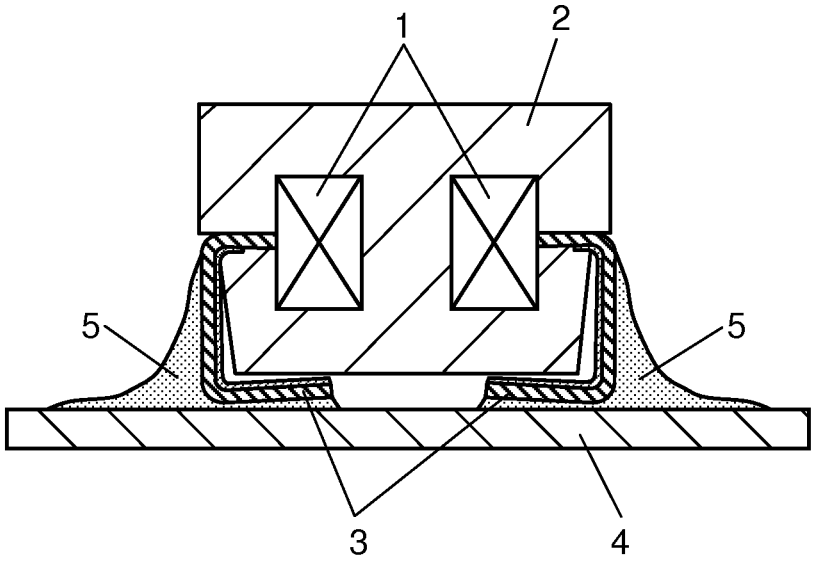
FIG. 13 PRIOR ART
FIG. 13 is a sectional view of a conventional coil component mounted to a substrate.

Before entering into the demonstration of the embodiments, we would like to explain the problems of the conventional coil components. A coil component for working with a large current is obliged to be large in size, so that vibration proof should be taken into consideration particularly for a car use. To be more specific, the coil component shown in FIG. 13 is large, and when its height becomes high, vibrations applied to this coil component invite a great stress to its soldered sections. The mechanical strength at terminal sections 3 or the soldered sections may thus be weakened. The coil component excellent in vibration proof, although it is large in size, is demonstrated hereinafter in the embodiments below.

Exemplary Embodiment 1

Figure 1:
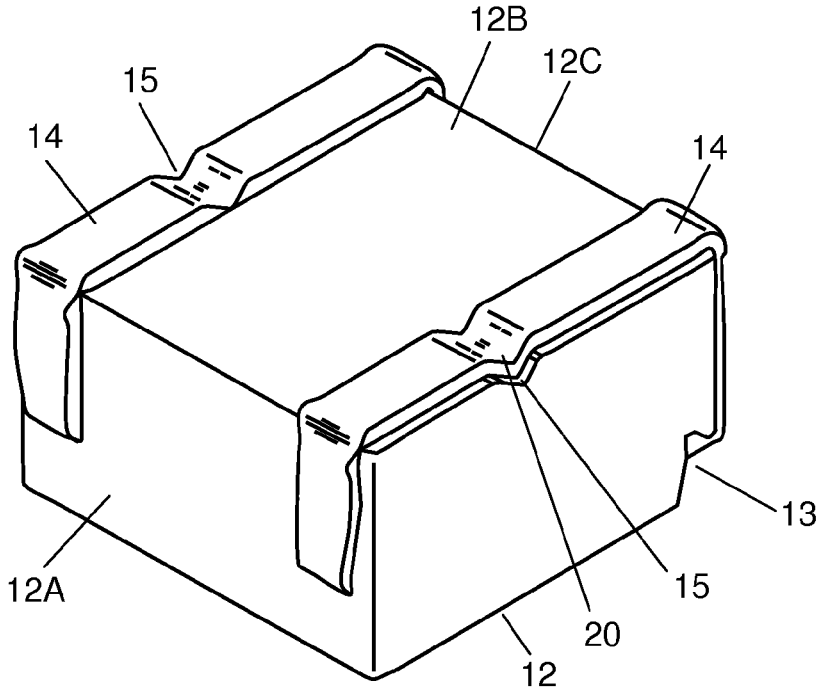
FIG. 1 is a perspective view of a coil component, viewed from its bottom side, in accordance with a first embodiment.
Figure 2:
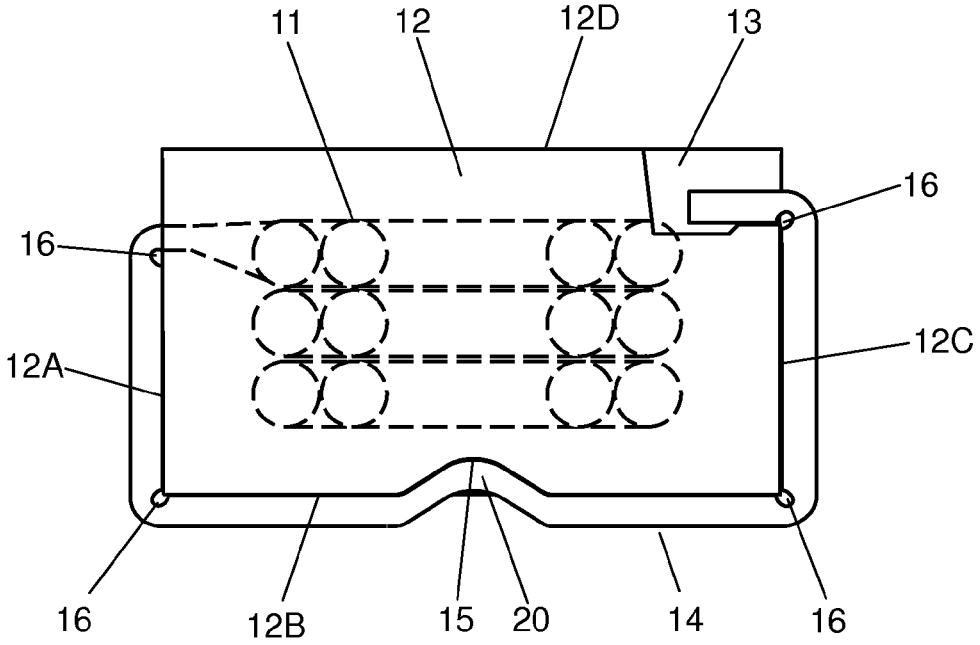
FIG. 2 is a lateral view of the coil component shown in FIG. 1.

FIG. 1 is a perspective view of a coil component, viewed from its bottom side, in accordance with the first embodiment. FIG. 2 is a lateral view of the coil component shown in FIG. 1. This coil component includes coil section 11, outer package 12, and a pair of outer electrodes 14.

Outer package 12 is made of magnetic material and coil section 11 is embedded therein. Outer package 12 has bottom face 12B and top face 12D opposite bottom face 12B. Top face 12D is provided with two cut-out sections 13. Outer package 12 also has first lateral face 12A and second lateral face 12C opposite first lateral face 12A.

Each one of outer electrodes 14 extends from both ends of coil section 11 respectively, and comes out from first lateral face 12A of outer package 12, and is bent toward bottom face 12B and further bent along bottom face 12B and second lateral face 12C, and then is bent toward cut-out section 13 of top face 12D. Recesses 15 are formed on bottom face 12B at places overlapped with respective outer electrodes 14, each of which is bent to form a projection protruding toward inside of corresponding each one of recesses 15.

The structural elements discussed above are demonstrated hereinafter with examples one by one. Coil section 11 is formed by winding a conductive wire, e.g. copper wire covered with insulating material, in a helical shape. Outer package 12 is made of a mixture of magnetic powder and binder, and then is pressure-molded. Outer package 12 embeds coil section 11 therein. The magnetic powder is metal powder produced by grinding an alloy of Fe, Si, and Cr, for example. The conductive wire is round wire having a diameter of approx. 1.2 mm, for example. Outer package 12 has bottom face 12B of approx. 13 mm×13 mm, and height of approx. 7 mm.

Both ends of coil section 11 are pulled out from first lateral face 12A of outer package 12, and are bent at the pulled-out place toward bottom face 12B. Both of these ends are then bent along bottom face 12B and second lateral face 12C, and are further bent toward top face 12D and cut-out sections 13, thus they are engaged at cut-out sections 13. Each end of coil section 11 is pulled out from first lateral face 12A of outer package 12, removed its insulating cover, and rigidly mounted on the surface of package 12 along first lateral face 12A, bottom face 12B and second lateral face 12C, whereby outer electrode 14 is formed. Outer electrodes 14, which are parts of the ends of coil section 11, are shaped like plates formed by pressing the round wire. A thickness of outer electrode 14 is approx. 0.5 mm, for example.

When the round wire is pressed for forming outer electrodes 14, notches 16 are preferably formed on electrodes 14 at the places to be bent. The presence of notches 16 prevents the bent sections from shifting when outer electrodes 14 are bent, so that outer electrodes 14 can be closely or solidly brought into contact with outer package 12.

As discussed above, the ends of coil section 11 is bent toward cut-out sections 13 formed on top face 12D of outer package 12, whereby the ends of coil section 11 are fixed to outer package 12 as outer electrodes 14. However, it is difficult for outer electrodes 14 to extend solidly along first lateral face 12A, bottom face 12B, and second lateral face 12C, because the structure discussed above tends to invite only a point contact between each of outer electrode 14 and outer package 12 at the corners of package 12. In other words, outer electrode 14 tends to touch outer package 12 only at places where first lateral face 12A adjoins bottom face 12B and second lateral face 12C adjoins bottom face 12B.

To overcome this problem, recesses 15 are formed on bottom face 12B at places overlapped with outer electrodes 14 respectively, and each of outer electrodes 14 is bent to fit into respective recess 15 for tightly binding itself around outer package 12. Outer electrodes 14 resultantly include projection 20 bent so as to protrude inward recesses 15, respectively. A depth of recess 15 is approx. 0.6 mm, for example. This structure achieves a face-contact between outer electrodes 14 and first lateral face 12A, bottom face 12B, and second lateral face 12C.

When this coil component is soldered to another item, outer electrodes 14 solidly contacting bottom face 12B, first lateral face 12A, and second lateral face 12C are used as a place to be soldered. The coil component thus becomes excellent in vibration proof. Furthermore, the solder tends to gather around recesses 15 in a greater amount than other places, so that this structure advantageously strengthens the vibration proof.

Figure 3:
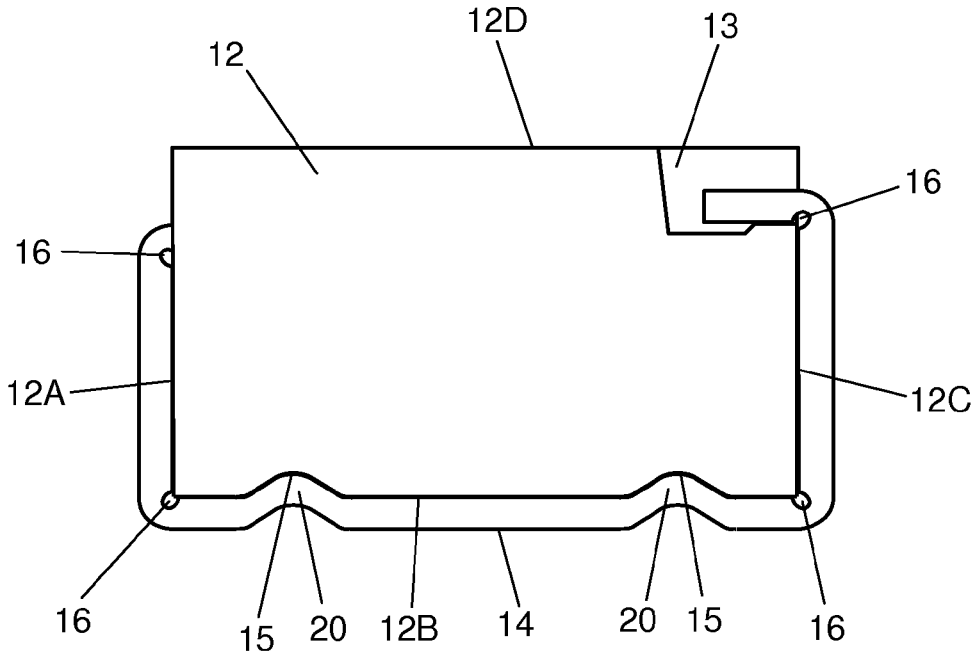
FIG. 3 is a lateral view of another coil component in accordance with the first embodiment.

In FIG. 2, one recess 15 is provided at the center of the portion, where outer electrode 14 overlaps, of bottom face 12B; however, as shown in FIG. 3, multiple recesses can be provided. FIG. 3 is a lateral view of another coil component in accordance with the present embodiment.

The presence of recess 15 reduces a thickness of the magnetic material of outer package 12 at those particular places, thereby inviting magnetic saturation with ease. The center section, overlapped with outer electrode 14, of bottom face 12B is near coil section 11 among other sections, so that the magnetic saturation tends to occur at this center section. To overcome this problem, recesses 15 are desirably formed at both sides of this center section as shown in FIG. 3. Preparing recesses 15 at the places other than the center section as discussed above will keep the thinner magnetic material sections away from coil section 11. The magnetic saturation is thus hard to occur, and outer electrode 14 can bind itself around outer package 12 with more strength. As a result, the depth of recesses 15 can be reduced, and yet, the magnetic saturation is harder to occur.

Preparing two projections 20 for one outer electrode 14 involves four recesses 15 on outer package 12. When this coil component is soldered to another item, the solder gathers around each one of recesses 15 in a greater amount than other places. As a result, the strength increases against rotating force about the winding axis of coil section 11.

A preferable shape of recess 15 is demonstrated hereinafter with reference to FIG. 4, which is a lateral view of still another coil component in accordance with the present embodiment.

Figure 4:
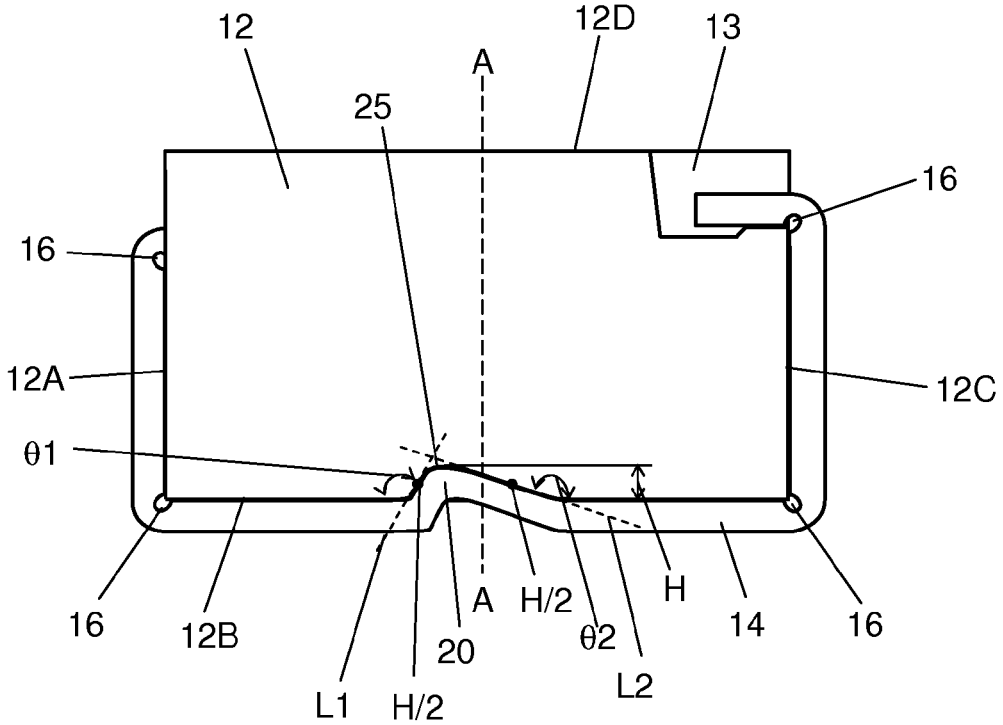
FIG. 4 is a lateral view of still another coil component in accordance with the first embodiment.

The coil component shown in FIG. 4 includes recesses 25 formed asymmetrically relative to a plane perpendicular to the extending direction of outer electrodes 14. The plane is expressed as the cross section cut along A-A line. To be more specific, the shape of recesses 25 can be defined as follows: Assume that a depth of each of recess 25 is H, and draw a tangent line L1 in contact with recess 25 at H/2 on the first lateral face 12A side, and another tangent line L2 in contact with recess 25 at H/2 on the second lateral face 12C side. Tangent lines L1 and L2 form respectively angles with bottom face 12B. The angle on the first lateral face 12A side is $\theta 1$ and the other angle on the second lateral face 12C side is $\theta 2$. Then the relation of $\theta 1<\theta 2$ is found.

After the preparation of recesses 25, outer electrodes 14 are bent toward recesses 25 respectively by using punches (not shown) each having a shape similar to recess 25. Then the portion of outer electrode 14 on the smaller angle $\theta 1$ side is sandwiched between outer package 12 and the punch, and engaged with outer package 12 strongly sooner than the portion on the greater angle $\theta 2$ side, and will not move anymore. When the punch is pushed further into recess 25, the portion of outer electrode 14 on the angle $\theta 2$ side is drawn into recess 25, whereby outer electrode 14 can more strongly tighten the portion of outer package 12 on the second lateral face 12C side. This structure thus corrects looseness, produced by spring back on outer electrode 14 engaged with cut-out section 13 on the second lateral face 12C side.

In FIG. 2 and FIG. 4, recess 15 or recess 25 is provided around the center section, overlapped with outer electrode 14, of bottom face 12B; however, the recess can be provided nearer to second lateral face 12C than the center section. In this case, the portion of outer package 12 on second lateral face 12C side can be more strongly tightened.

Figure 5:
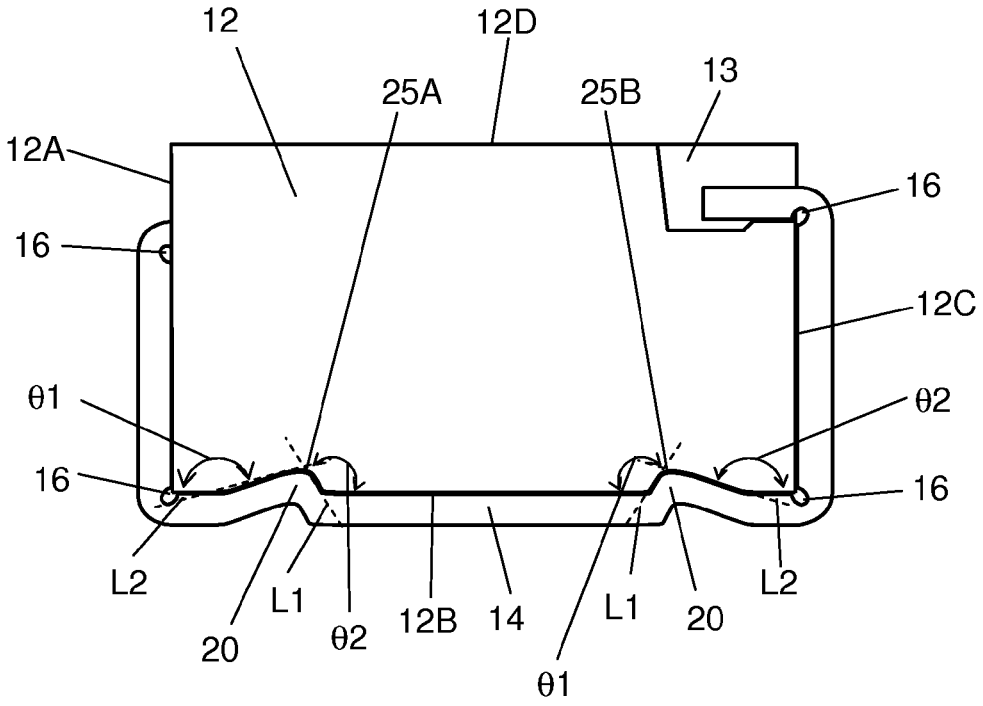
FIG. 5 is a lateral view of yet another coil component in accordance with the first embodiment.

Moreover, as shown in FIG. 5, two asymmetric recesses 25A and 25B similar to recess 25 can be formed. FIG. 5 is a lateral view of yet another coil component in accordance with the present embodiment.

In this coil component, recess 25A closer to first lateral face 12A satisfies the relation of $\theta 1>\theta 2$, and recess 25B closer to second lateral face 12C satisfies the relation of $\theta 1<\theta 2$, where angles $\theta 1$ and $\theta 2$ are defined in the same way as illustrated in FIG. 4. The section between recess 25A and recess 25B is pulled toward recess 25A and recess 25B, so that the closer or the more solid contact between outer electrode 14 and outer package 12 can be expected with less force applied thereto.

Figure 6:
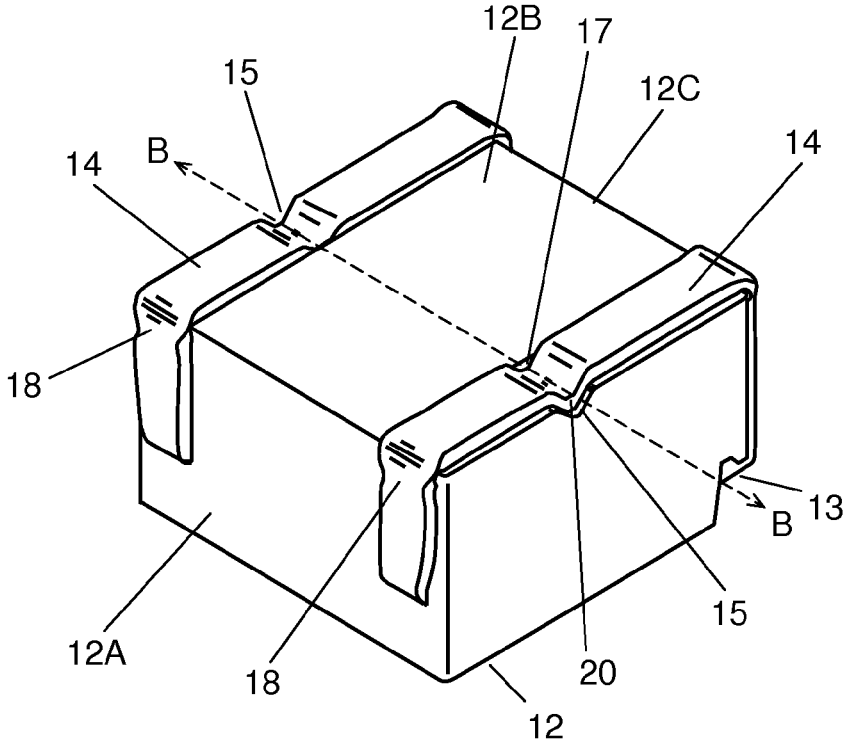
FIG. 6 is a lateral view of yet still another coil component in accordance with the first embodiment.

As FIG. 6 shows, steps 17 having a height less than thickness of outer electrode 14 can be provided to bottom face 12B at places with which outer electrodes 14 are brought into contact. FIG. 6 is a perspective view of yet still another coil component, viewed from its bottom face side, in accordance with the present embodiment.

Presence of steps 17 increases the strength against force along a direction (direction along B-B line in FIG. 6) perpendicular to the extending direction of outer electrode 14.

Figure 7:
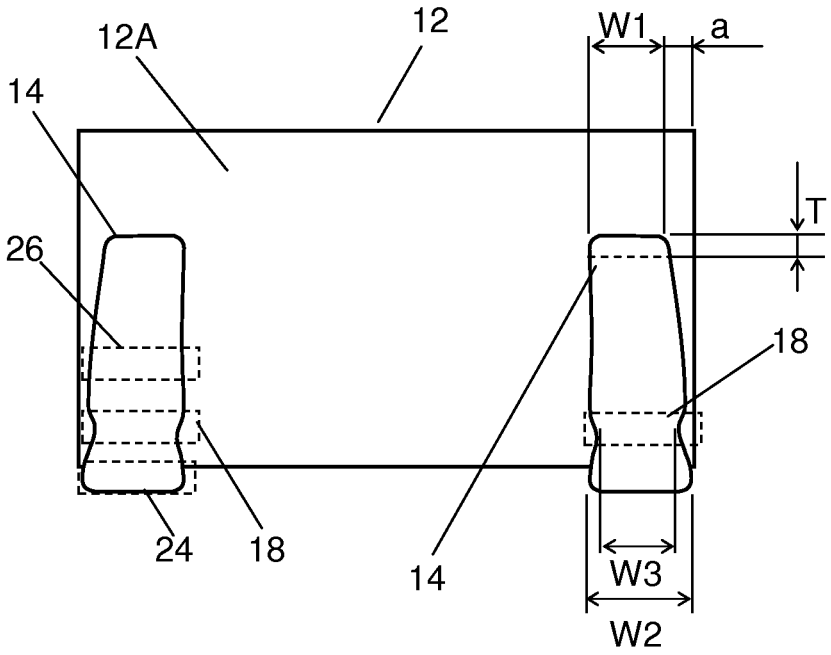
FIG. 7 is a lateral view showing a first lateral face of the coil component shown in FIG. 1.

A preferable shape of outer electrode 14 is demonstrated hereinafter. FIG. 7 is a lateral view of first face 12A of the coil component in accordance with the present embodiment.

Each of outer electrodes 14 is pulled out from first lateral face 12A of outer package 12. A width (W1) of the portion of outer electrode 14 pulled out is approx. 1.6 mm, and a thickness (T) thereof is approx. 0.4 mm. The side end of pulled-out outer electrode 14 is located at position (a) inward by approx. 0.5 mm from the end of first lateral face 12A. Pulled-out outer electrode 14 is bent toward bottom face 12B. The bent section 24 of electrode 14 around bottom face 12B has a width (W2) of approx. 2.2 mm. If outer package 12 is pressure-molded while outer electrode 14 is pulled-out from outer package 12, outer package 12 tends to suffer cracks. To overcome this problem, the pulling-out position (a) of outer electrode 14 from outer package 12 is preferably greater than the thickness (T) of outer electrode 14. This structure prevents the cracks from being produced.

On the other hand, the side edge of the portion of outer electrode 14 extending on bottom face 12B is preferably placed near the edge of outer package 12 because of the heat produced by the soldering. To be more specific, the width (W2) of the bent section around bottom face 12B is preferably wider than the width (W1) of the pulled-out section from package 12. This structure enables bent section 24 of outer electrode 14 to be formed near the edge of outer package 12 when outer electrode 14 pulled out from outer package 12 is extended straight down toward bottom face 12B.

Outer electrode 14 preferably includes narrowed section 18 along first lateral face 12A. Narrowed section 18 has a width (W3) of approx. 1.8 mm. When the coil component is soldered to a printed wiring board, solder fillet is formed on outer electrode 14 along first lateral face 12A. A greater height of the coil component will allow the solder fillet to rise higher, so that a shape of the solder fillet tends to disperse. However, the presence of narrowed section 18 prevents the solder fillet from rising higher than narrowed section 18, so that a stable shape of the solder fillet can be expected. Narrowed section 18 is preferably formed on first lateral face 12A at a place nearer to bottom face 12B than to center section 26 along the extending direction of outer electrode 14 so that the advantage discussed above can be obtained.

Exemplary Embodiment 2

Figure 8:
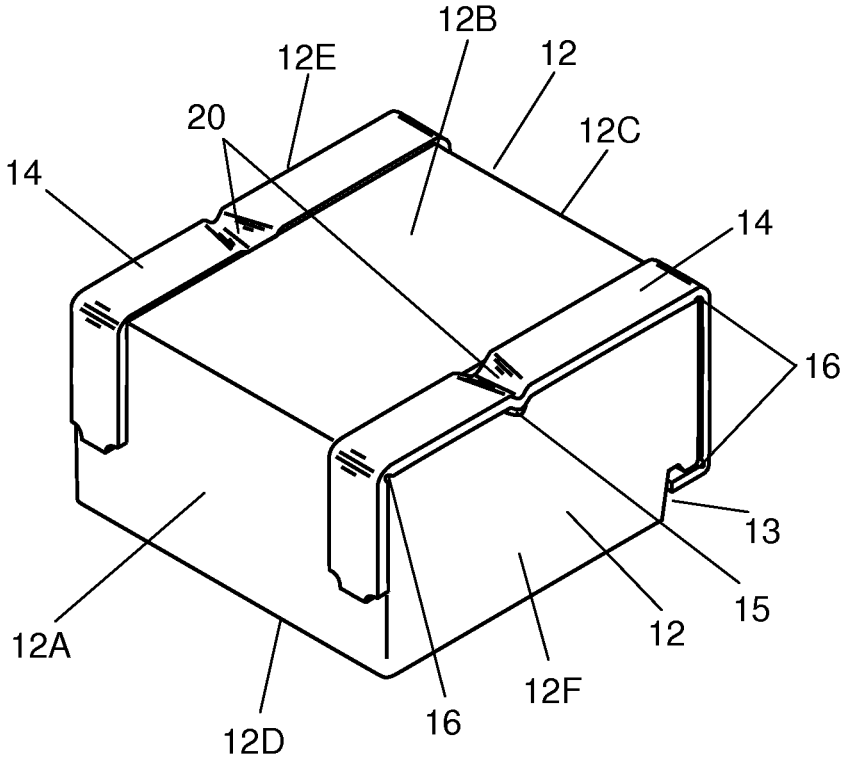
FIG. 8 is a perspective view of a coil component, viewed from its bottom side, in accordance with a second embodiment.
Figure 9:
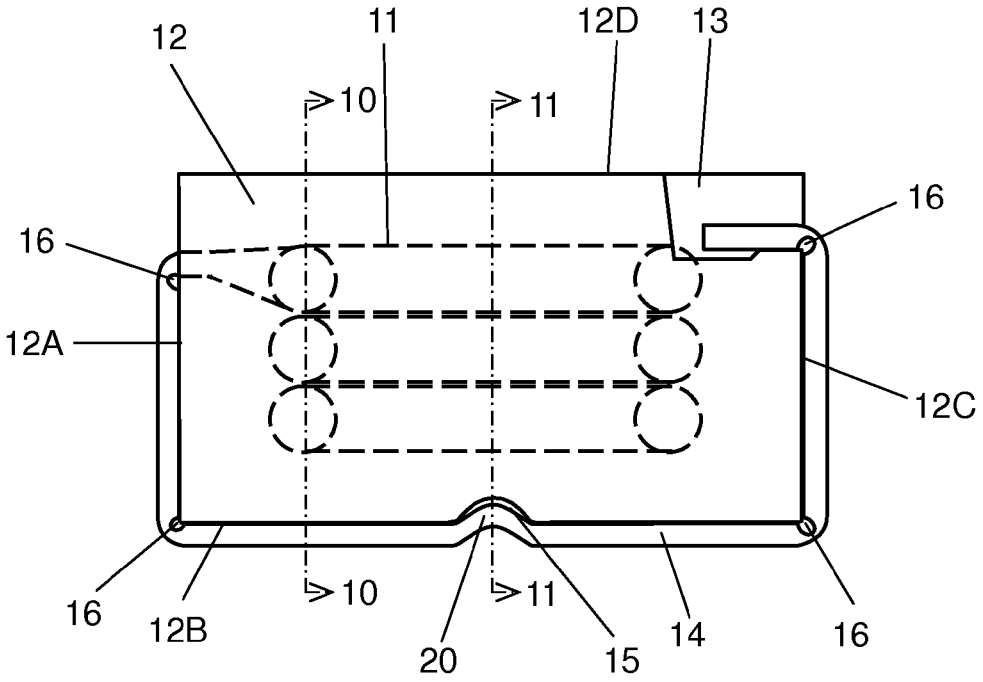
FIG. 9 is a lateral view of the coil component shown in FIG. 8.
Figure 10:
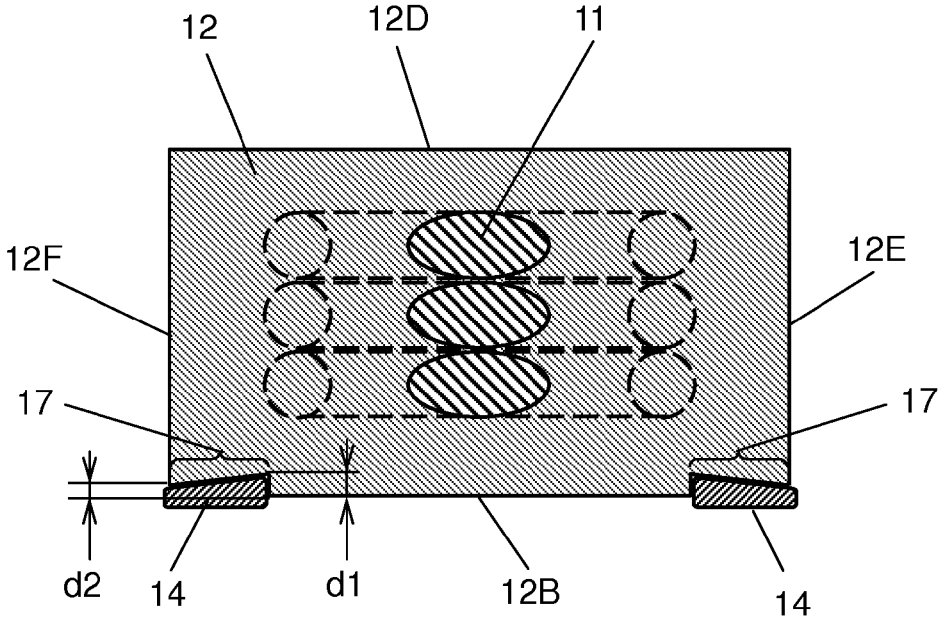
FIG. 10 is a sectional view cut along line 10-10 in FIG. 9.
Figure 11:
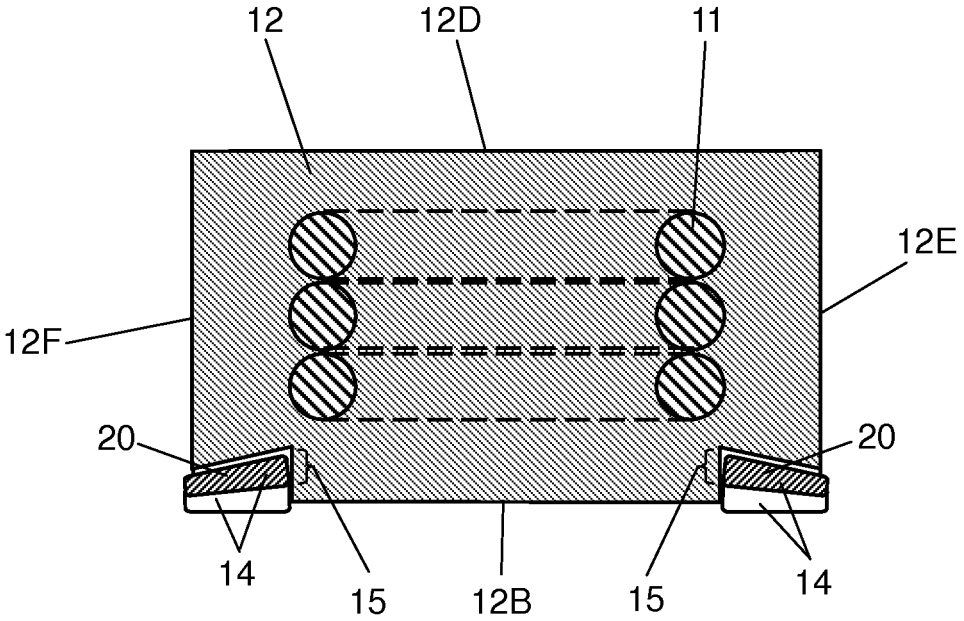
FIG. 11 is a sectional view cut along line 11-11 in FIG. 9.

A coil component in accordance with the second embodiment is demonstrated hereinafter with reference to FIG. 8-FIG. 11. FIG. 8 is a perspective view of the coil component, viewed from its bottom side, in accordance with the second embodiment. FIG. 9 is a lateral view of the coil component shown in FIG. 8. FIG. 10 is a sectional view cut along line 10-10 in FIG. 9. FIG. 11 is a sectional view cut along line 11-11 in FIG. 9. Structural elements similar to those in the first embodiment have the same reference marks and the detailed descriptions thereof may be omitted here.

As shown in FIG. 10, steps 17 are provided to bottom face 12B at places with which outer electrodes 14 is in contact, and a depth of each of steps 17 on the center side is greater than a depth thereof along third lateral face 12E or fourth lateral face 12F. In other words, a height of step 17 on the center side of bottom face 12B is greater than a height thereof on the other side, namely, nearer to third lateral face 12E or fourth lateral face 12F. For instance, depth d1 of step 17 on the center section side of bottom face 12B is approx. 0.4 mm, and depth d2 nearer to third lateral face 12E or fourth lateral face 12F is approx. 0.2 mm.

As described previously, outer electrode 14 is formed by pressing the round wire of coil section 11, and shapes like a plate. Outer electrode 14 in contact with bottom face 12B is thicker on the center side of bottom face 12B than at the positions along third lateral face 12E or fourth lateral face 12F. For instance, the thickness on the center side of bottom face 12B is approx. 0.6 mm and the thickness along third lateral face 12E or fourth lateral face 12F is approx. 0.4 mm. This structure allows outer electrode 14 to resist the stress applied from the center side of bottom face 12B toward third lateral face 12E or fourth lateral face 12F, so that outer electrode 14 is hard to come out from outer package 12, and the vibration proof can be increased. In addition, modifying the shape of outer electrode 14 to fit to step 17 can make the mounting face of the coil component flat.

When the coil component is viewed from third lateral face 12E, it is preferable that the lateral face of outer electrode 14 is entirely exposed. Meanwhile, first lateral face 12A and second lateral face 12C cross third lateral face 12E at right angles on the ends of third lateral face 12E. This entire exposure increases an area subjected to hot air generated during reflow-soldering, so that heat absorption can be improved, and the soldering can be done more efficiently. Solder fillet can be formed also on the lateral face of outer electrode 14, so that vibration proof is further strengthened.

As shown in FIG. 11, recesses 15 are provided inside steps 17 formed on bottom face 12B, respectively. A depth of recess 15 nearer on the center side of bottom face 12B is greater than a depth thereof along third lateral face 12E or fourth lateral face 12F. For instance, the depth of recess 15 on the center side of bottom face 12B is approx. 0.6 mm measured from step 17, and the depth thereof on third lateral face 12E or fourth lateral face 12F is approx. 0.4 mm measured from step 17.

Outer electrode 14 is pushed toward recess 15, thereby fastening outer electrode 14. To be more specific, projection 20 protrudes more deeply into recess 15 on the center section side of bottom face 12B than on third lateral face 12E side or fourth lateral 12F side. This structure ensures the face contact more positively between outer electrode 14 and each of first lateral face 12A, bottom face 12B, and second lateral face 12C.

When this coil component is soldered to another item, outer electrode 14 is used as a place to be soldered, and as discussed above, outer electrode 14 is in solid contact across bottom face 12B, and in solid contact with first lateral face 12A and second lateral face 12C. This structure strengthens the vibration proof of the coil component, and on top of that, the solder is gathered around recess 15 in a greater amount, so that the vibration proof is advantageously improved.

When outer electrode 14 is pushed into recess 15, it is pushed deeper on the center side of bottom face 12B than on third lateral face 12E side or fourth lateral face 12F side. This structure allows outer electrode 14 to resist the stress applied from the center side of bottom face 12B toward the position along third lateral face 12E or fourth lateral face 12F, so that outer electrode 14 is hard to come out from outer package 12, and the vibration proof can be further strengthened.

As FIG. 8 shows, recess 15 viewed from bottom face 12B side preferably has a width narrower on the center side of bottom face 12B than on the third lateral face 12E side or the fourth lateral face 12F side. This shape of recess 15 allows outer electrode 14 to resist the stress applied from the center side of bottom face 12B toward third lateral face 12E or fourth lateral face 12F, so that outer electrode 14 is hard to come out from outer package 12, and the vibration proof can be further strengthened.

The foregoing descriptions disclose that step 17 is formed across bottom face 12B, i.e. from first lateral face 12A to second lateral face 12C, at the place with which outer electrode 14 is brought into contact. However, step 17 is not necessarily formed across bottom face 12B, but it can be formed at least ⅓ length of the foregoing place, so that similar advantage discussed above can be obtained.

Step 17 can be formed not only on bottom face 12B but also on first lateral face 12A and second lateral face 12C.

Figure 12:
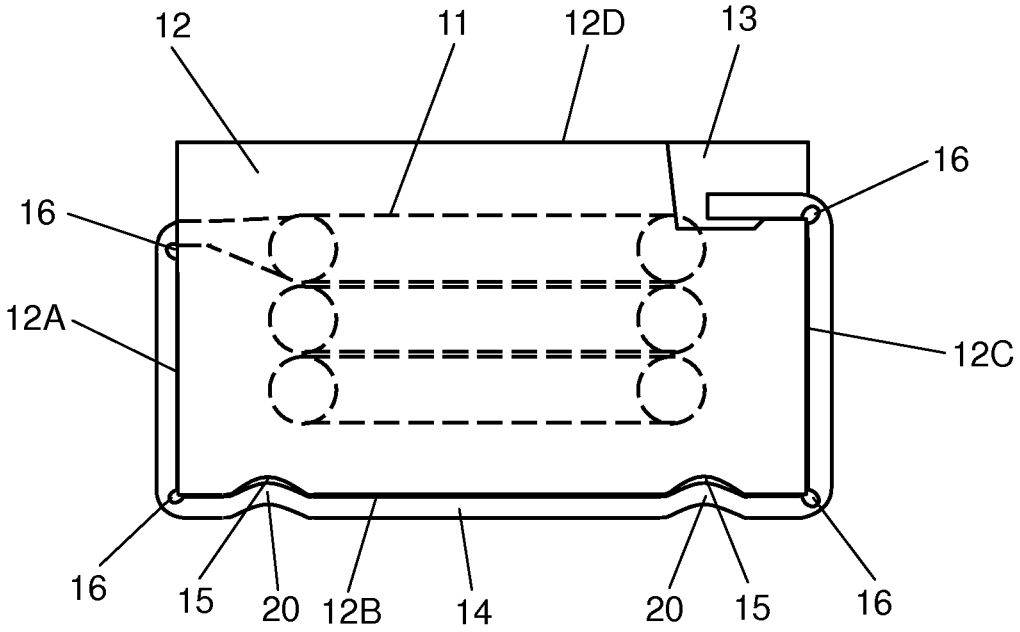
FIG. 12 is a lateral view of another coil component in accordance with the second embodiment.

In the present embodiment as same as the first embodiment, multiple recesses 15 can be formed as shown in FIG. 12 which is a lateral view of another coil component in accordance with the second embodiment. Multiple recesses 15 have been discussed already in the first embodiment, and the same advantage can be produced also in this second embodiment. Although this is not illustrated, recesses 25A and 25B as shown in FIG. 5 can be formed.

When the round wire of coil section 11 is pressed to form outer electrode 14, it is preferable to provide notches 16 to outer electrode 14 at places supposed to be bent. The reason of providing notches 16 is same as the first embodiment.

The coil components in accordance with the first and second embodiments are useful for industrial use because they are excellent in vibration proof even if they are larger in size.

What is claimed is:

1. A coil component comprising:

a coil section;

an outer package made of magnetic material, including the coil section embedded therein, and having a bottom face, a top face disposed opposite the bottom face and having cut-out sections, a first lateral face, and a second lateral face opposite the first lateral face; and a pair of outer electrodes, each extending from corresponding one end of the coil section, pulled out from the first lateral face, bent toward the bottom face, further bent along the bottom face and the second lateral face, and yet bent toward corresponding one of the cut-out sections of the top face, wherein the bottom face includes recesses at places overlapped with the pair of outer electrodes respectively, and each one of the outer electrodes is bent to form a projection protruding toward inside of corresponding each one of the recesses.

2. The coil component according to claim 1, wherein each of the recesses is one of a plurality of recesses, and each of the projections is one of a plurality of projections, and the plurality of the recesses is formed on the bottom face correspondingly to the pair of the outer electrodes, and the plurality of the projections protrudes respectively toward inside of the plurality of the recesses.

3. The coil component according to claim 1, wherein the recesses are formed asymmetrically with respect to a plane perpendicular to an extending direction of the outer electrodes.

4. The coil component according to claim 1, wherein a width of the outer electrodes on the first lateral face at a pulled-out section from the outer package is smaller than a width of the outer electrodes on the first lateral face at a bent section toward the bottom face.

5. The coil component according to claim 4, wherein the outer electrodes include a narrowed section on the first lateral face between the pulled-out section from the outer package and the bent section toward the bottom face.

6. The coil component according to claim 5, wherein, on the first lateral face, the narrowed section of the outer electrodes is formed closer to the bent section than to a center section along the extending direction of the outer electrodes.

7. The coil component according to claim 1, wherein the outer package further has a third lateral face and a fourth lateral face between the first lateral face and the second lateral face, and wherein steps are formed on the bottom face of the outer package at sections in contact with the outer electrodes, and a height of the steps is greater at a closer side to a center section of the bottom face than at a closer side to the third lateral face or the fourth lateral face.

8. The coil component according to claim 7, wherein the recesses are formed in the steps, and the projections protrude into the recesses deeper at a closer side to the center section of the bottom face than at a closer side to the third lateral face or the fourth lateral face.

9. The coil component according to claim 7, wherein portions of the outer electrodes in contact with the bottom face are thicker at sides closer to the center section than at other sides closer to the third lateral face or the fourth lateral face.

10. The coil component according to claim 1, wherein the coil section comprises a wound conductive wire, and a tip of each of the pair of outer electrodes is engaged at one of the cut-out sections.

11. The coil component according to claim 10, wherein each of the pair of outer electrodes is formed by deforming each of both ends of the coil section into a plate shape.

12. The coil component according to clai herein each of the pair of outer electrodes is provided with notches at a bent portion between a portion along the first lateral face and a portion along the bottom face, and at a bent portion between the portion along the bottom face and a portion along the second lateral face.

13. The coil component according to claim 1, wherein a step portion situated nearer the bottom face than the top face is formed in each of the cut-out sections, and each of the pair of outer electrodes is bent so that a tip of each of the pair of outer electrodes is on the step portion.

14. The coil component according to claim 1, wherein the recesses are provided on the bottom face away from a boundary line between the bottom face and the first lateral face and a boundary line between the bottom face and the second lateral face.

15. The coil component according to claim 1, wherein the pair of outer electrodes are across the bottom face between the first lateral face and the second lateral face.

* * * * *